US008606092B2

(12) United States Patent
Amiran et al.

(10) Patent No.: US 8,606,092 B2
(45) Date of Patent: Dec. 10, 2013

(54) CONTROLLING THE OPERATION OF AN ELECTRICALLY HEATED WATER TANK

(75) Inventors: Ran Amiran, Tel-Aviv (IL); Oren Graiver, Petach Tikva (IL)

(73) Assignee: Proximotech Ltd. (IL)

( * ) Notice: Subject to any disclaimer, the term of this patent is extended or adjusted under 35 U.S.C. 154(b) by 321 days.

(21) Appl. No.: 12/990,748

(22) PCT Filed: May 20, 2009

(86) PCT No.: PCT/IL2009/000501
§ 371 (c)(1),
(2), (4) Date: Nov. 2, 2010

(87) PCT Pub. No.: WO2009/144710
PCT Pub. Date: Dec. 3, 2009

(65) Prior Publication Data

US 2011/0044671 A1 Feb. 24, 2011

(30) Foreign Application Priority Data

May 26, 2008 (IL) ..... 191719

(51) Int. Cl.
*A47J 31/54* (2006.01)
*F24D 19/10* (2006.01)

(52) U.S. Cl.
USPC ..... 392/441; 237/8 A

(58) Field of Classification Search
USPC ..... 392/308, 441, 449, 451; 219/482, 483, 219/490–494, 507–510; 236/20 R, 25 R; 237/8 R, 8 A, 8 B
See application file for complete search history.

(56) References Cited

U.S. PATENT DOCUMENTS

| | | | | |
|---|---|---|---|---|
| 5,103,078 | A * | 4/1992 | Boykin et al. | 219/494 |
| 5,723,847 | A * | 3/1998 | Boldt | 219/506 |
| 6,242,720 | B1 * | 6/2001 | Wilson et al. | 219/486 |
| 6,293,471 | B1 | 9/2001 | Stettin et al. | |
| 6,375,087 | B1 * | 4/2002 | Day et al. | 237/8 A |
| 6,989,514 | B2 | 1/2006 | Patterson et al. | |
| 7,209,804 | B2 * | 4/2007 | Curt et al. | 700/286 |

FOREIGN PATENT DOCUMENTS

| | | |
|---|---|---|
| EP | 1840479 | 10/2007 |
| WO | 0235154 | 5/2002 |
| WO | 2006096075 | 9/2006 |

OTHER PUBLICATIONS

Office Action for application 191719 issued by the Israeli Patent Office dated Jan. 16, 2012.

* cited by examiner

*Primary Examiner* — Sang Paik
(74) *Attorney, Agent, or Firm* — Daniel Feigelson

(57) ABSTRACT

A system for controlling the operation of the electric heating element in a water tank. The system comprises a temperature sensor in the water tank connected to a main control unit. User preferences related to hot water supply are inputted via a friendly user interface and the main control unit controls the operation of the heating element in the water tank to supply hot water according to the user preferences with minimal energy consumption.

19 Claims, 5 Drawing Sheets

CONTROLLING THE OPERATION OF AN ELECTRICALLY HEATED WATER TANK

CROSS REFERENCE TO RELATED APPLICATIONS

This application is a national stage application claiming priority to international patent application No. PCT/IL2009/000501 filed on May 20, 2009 which in turn claimed priority to Israeli patent Application No. 191719 filed on May 26, 2008.

FIELD OF THE INVENTION

The present invention generally relates to the field of energy use. More particularly, the present invention relates to reducing electric power consumption in water heating systems.

BACKGROUND OF THE INVENTION

Residential hot water tanks equipped with means for controlling the heating process for all kind of purposes are known in the art. In some hot water tanks, the heating is controlled to avoid electricity failure and to maintain constant supply of hot water. In other hot water tanks, the heating is controlled based on user supplied requirements associated with, for example, specified hours of operation. In the last few years, the design of reduced power consumption electrical appliances, specifically power hungry devices such as hot water tanks, has become an ongoing challenge.

SUMMARY

The present invention discloses a system for controlling the operation of an electric heating element in a water tank. The system comprises at least one temperature sensor in the water tank arranged to measure water temperature inside the water tank, and a main control unit arranged to receive water temperature measurements from the temperature sensor and arranged to control the operation of the electric heating element. The main control unit comprises a user interface configured to allow a user to input preferences relating to hot water supply and configured to display information relating to the temperature of the water in the water tank, and a control application configured to activate the electric heating element according to user preferences and the water temperature measurements. The control application is configured to minimize the energy consumption of the water tank.

The present invention further discloses a method for reducing the consumption of electricity while supplying heated water from a water tank with an electric heating element. The method comprises: (i) measuring water temperature in the water tank in predefined intervals and predefined locations in the water tank; (ii) defining user preferences of heated water supply; (iii) utilizing the measured water temperature to calculate the minimal consumption of electricity required to fulfill the defined user preferences; and (iv) controlling the operation of the electric heating element according to the calculated minimal consumption of electricity.

BRIEF DESCRIPTION OF THE DRAWINGS

The subject matter regarded as the invention will become more clearly understood in light of the ensuing description of embodiments herein, given by way of example and for purposes of illustrative discussion of the present invention only, with reference to the accompanying drawings (Figures, or simply "FIGS."), wherein.

DETAILED DESCRIPTIONS OF SOME EMBODIMENTS OF THE INVENTION

Figure 1:
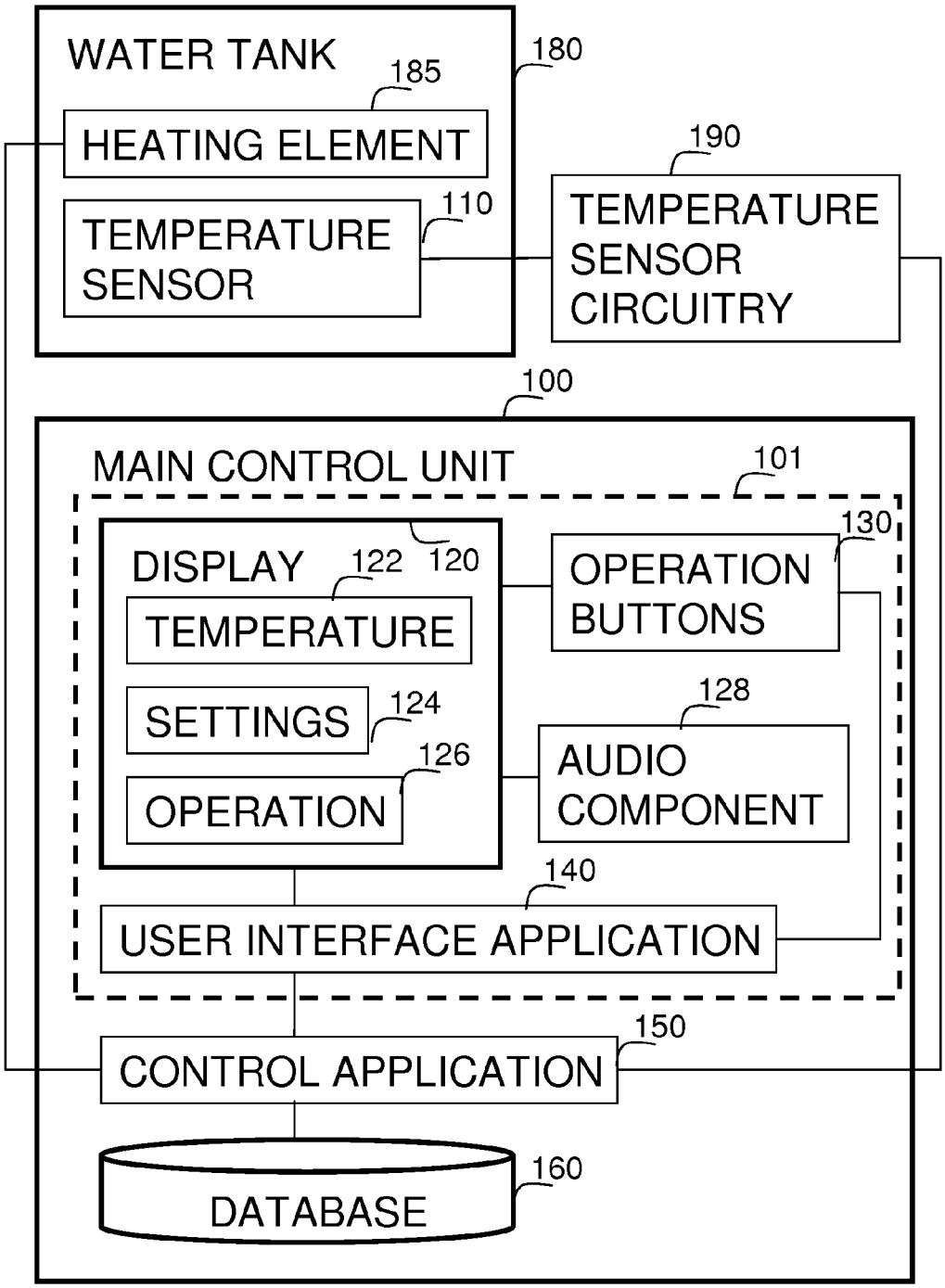
FIG. 1 is a block diagram illustrating a system for controlling the operation of an electric heating element in a water tank, according to some embodiments of the invention.

The present invention discloses an intelligent and efficient control unit for either electrical or solar water tanks (boilers), incorporating friendly and intuitive user interface for the following purposes:

- Presenting the temperature of the water in the tank.
- Controlling the operation of the electric heating element.
- Efficient water heating capabilities for a specified usage, preventing excess power consumption and hence save energy.
- Preventing waste of water when checking to see if hot water are available by running water through the faucet.
- Acting as a safety gauge to prevent burns that may be caused by extremely hot water.
- Adaptive prediction capabilities of heating periods for water to reach required temperature.
- Learning the usage habits for a user-free system activation by a hands free artificial intelligent mechanism with an automatic user usage habit learning algorithm FIG. 1 is a block diagram illustrating a system for controlling the operation of an electric heating element 185 in a water tank 180, according to some embodiments of the invention. The water tank 180 is equipped with a temperature sensor 110 connected via a temperature control circuitry 190 to a main control unit 100. The temperature sensor 110 is fitted on top of the existing water tank thermometer without any affect to its normal operation and safety role. The main control unit 100 is connected to the heating element 185 in the water tank 180, receives water temperature measurements from the temperature sensor 110, and controls the operation of the heating element 185 according to the measured temperature and the user's preferences. The main control unit 100, the heating element 185, the temperature sensor 110 and the temperature control circuitry 190 may be connected to each other via a communication link or per wires or a combination of these connection forms. The main control unit 100 comprises a user interface 101 and a control application 150.

According to some embodiments of the invention, the user interface 101 comprises a user interface application 140 controlling a display 120 presenting e.g. temperature data 122 relating to the water temperature in the water tank, settings 124 of the system and of user preferences and operation data 126 of the water tank, heating element 110, faucets etc. The user interface application 140 may further control an audio component 128 for delivering information, warnings and indications as sounds or messages. The user interface 101 may further comprise operation buttons 130 allowing the user to set operation times, define target temperatures, program the system etc. The user interface 101 is configured to allow a user to input preferences relating to hot water supply and to display information relating to the temperature of the water in the water tank.

According to some embodiments of the invention, the control application 150 receives temperature measurements from the temperature sensor 110 via the temperature control circuitry 190 and control the electric heating element 185. The control application 150 configured to activate the electric heating element 110 according to user preferences inputted via the user interface 101, according the water temperature measurements and according to optimization algorithms. The control application 150 may be configured to minimize the energy consumption of the water tank 180.

According to some embodiments of the invention, the main control unit 100 further comprises a database 160 holding records of user preferences and data related to the operation of the water tank 180. The control application 150 may use data from the database 160 to optimize the operation of the water tank 180, report changing characteristics of operation of the tank 180 (e.g. deteriorating efficiency) and learn patterns of usage and habits of the user that may contribute to the automatization of water tank operation.

According to some embodiments of the invention, the main control unit 100 may be located at an imminent visible location within the house (House entrance, leaving room, Kitchen, etc.). The main control unit 100 may comprise a remotely sensing unit installed within the water heating tank. The main control unit may be connected to the remotely sensing unit via a communication link.

According to some embodiments of the invention, communication links in the system (e.g. between some or all of the following: the main control unit 100, the remotely sensing unit, the heating element 185, the temperature sensor 110, the temperature control circuitry 190) may utilize power line communication technologies allowing communication over power lines.

According to some embodiments of the invention, the temperature sensor circuitry 190 may be enclosed in a unified structured element, build in a 'sleeve' layout pinned on top of existing safety mechanical thermometer.

According to some embodiments of the invention, the main control unit may comprise a microcontroller and a heavy duty Bi-poll switching device.

According to some embodiments of the invention, multiple temperature sensors 110 may be installed in different locations within the water tank 180. The temperature sensor 110 may be installed within the existing thermometer housing in addition to the current thermometer, without any affect on current functionality.

Figure 2:
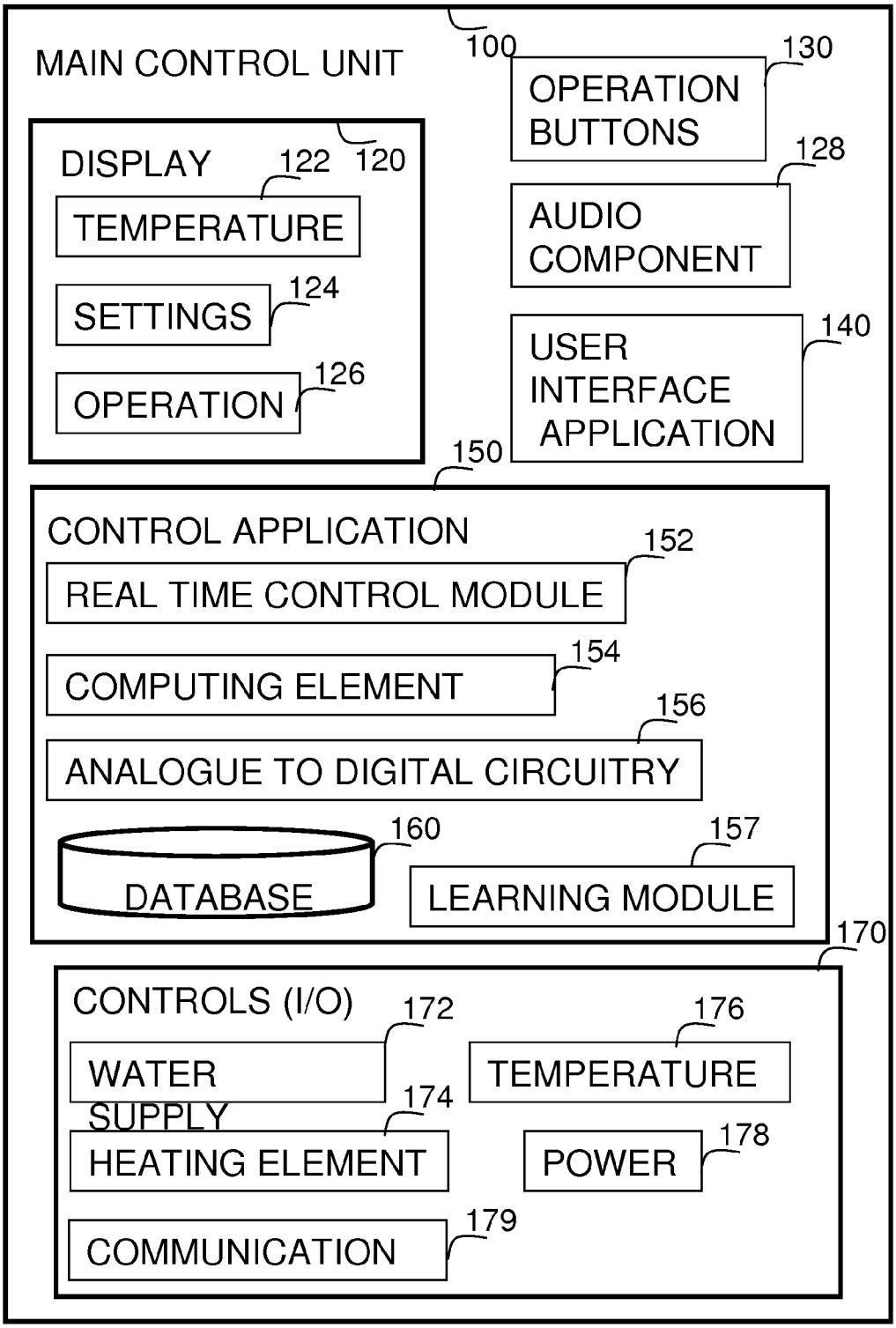
FIG. 2 is a block diagram illustrating the main control unit of the system for controlling the operation of an electric heating element in a water tank, according to some embodiments of the invention.

FIG. 2 is a block diagram illustrating the main control unit 100 of the system for controlling the operation of an electric heating element 185 in a water tank 180, according to some embodiments of the invention. In addition to the elements described in FIG. 1, the main control unit 100 may further comprise a controls (input output—I/O) unit 170 with several modules. A water supply module 172 may receive data such as amounts of incoming and outgoing water into and from the water tank 180, water stand in the water tank 180, operation of faucets. The water supply module 172 may further control the operation of faucets related to the water tank 180. A heating element module 174 may control the activation of the electric heating element 185. A temperature module 176 may receive data from the temperature sensor 110 inside the water tank, from an array of temperature sensors in the water tank 180 or from temperature sensors outside the water tank 180. A power module 178 may control the power supplied to the water tank 180 and regulate the intensity of its operation. A communication module 179 may allow external sources to connect to the main control system 100 e.g. for retrieving or providing data, and via a physical connection or a communication link to different sources.

According to some embodiments of the invention, the communication module 179 may support any of the following interfaces, that may be used to configure and control the control unit 100 from a home personal computer or a laptop: A USB interface, a wire line (LAN) network, a wireless (WLAN) network, a cellular interface. The cellular interface may be based on SMS commands by a remote authorized user, where the user can send activation/De-activation/Programming commands via SMS indication in the following manner:<User> <Password> <Command (1-Single/2-Continues)> <Temperature> (Example: Richard 12345 1 50).

According to some embodiments of the invention, the control application 150 in the main control unit 100 may comprise a real time control module 152, a computing element 154, an analogue to digital circuitry 156 and a learning module 157 implementing a learning algorithm for learning user preferences and habits.

According to some embodiments of the invention, the water in the water tank 180 is heated via accurate control mechanism to specific pre-defined temperature levels using a friendly, easy to operate, control panel in the user interface 101. Once the water reaches desired temperature level, the heating element 185 is halted. An audio/visual indication is provided to indicate water reached desired temperature level and hence, ready for use. In case warm water consumption is postponed; user can choose operation mode, either the control unit 100 will intermittently activate the heating element 185 to preserve desired water temperature (without over heating) or to halt operation. This reduces the amount of energy invested in the water heating process as the user can choose the level of water temperature to be heated and thus save energy invested in unnecessary water heating not being consumed. The heating element 185 will be stopped once water reached required bathing/dish-washing temperature, while in current system the water are usually heated to a much higher temperature. In case the user does not consume the hot water immediately, the system 100 can (if instructed to do so) preserve desired water temperature level without excess heating.

According to some embodiments of the invention, water temperature may be set via the user interface 101, and the system provides an audio or visual indication once the water reached desired temperature level. According to some embodiments of the invention, the system may allow the user to set a daily timer to predefined daily heating periods and may use an algorithm to estimate time remaining for the water heating system In the tank to reach the desired temperature. According to some embodiments of the invention, the system may include indication of time and date, pre-defined operation intervals may be set for hot water pre-heat within intra day, daily or weekly ranges. The system may further support remote management and control capabilities via one of the following interfaces: Mobile GSM module—Short Message response (SMS) activation mechanism, Ethernet PHY—Control by IP technology of a computerized element, WLAN—Activation by IP technology of a computerized element or Bluetooth—for the purpose of control by a Bluetooth enabled device. Different embodiments may be provided to the user as alternative, upgradeable options.

According to some embodiments of the invention, the display 120 may comprise a LED based display or an LCD based display (Numerical and Graphical display) of the current water tank temperature, the desired or target tank temperature, and indication of the status of the heating element (On/Off) and a desired water temperature 'Ready' indication. The operation buttons 130 may comprise and "Off" button, buttons for adjusting the desired temperature adjustment (Up/Down), and buttons for single and continuous (water temperature preserving) operation.

According to some embodiments of the invention, the display 120 may comprise a LED and an LCD based display. The LCD based display may show the current water tank temperature, the desired or target tank temperature, and indication of the status of the heating element (On/Off) and a desired water temperature 'Ready' indication, the time for water to reach defined 'set' temperature. The display 120 may further comprise a 7 segment/LCD display for 'Hour: Minutes'. The operation buttons 130 may comprise and "Off" button, buttons for adjusting the desired temperature adjustment (Up/Down), and buttons for single and continuous (water temperature preserving) operation, as well as daily timer set buttons.

According to some embodiments of the invention the display 120 may present data graphically. The data may be displayed in different levels of details and simplification.

According to some embodiments of the invention, the display 120 may comprise an illuminated LCD based showing any combination of the following: The current water tank temperature, the desired or target tank temperature, and indication of the status of the heating element (On/Off) and a desired water temperature 'Ready' indication, the time for water to reach defined 'set' temperature, time and day, an indication of programs and program details. The display 120 may further comprise indications for GSM signal reception, online indication, provider brand, SMS notification and remote activation; as well as an Ethernet/WLAN connection indication. The operation buttons 130 may comprise and "Off" button, buttons for adjusting the desired temperature adjustment (Up/Down), and buttons for single and continuous (water temperature preserving) operation, as well as daily timer set buttons. The operation buttons 130 may comprise means for date and time adjustment, a programming keypad and a toggle for inputting the desired water temperature and/or the current environment temperature. The user interface 101 may further comprise a module allowing remote control, e.g. programming and notifications via SMS or the web. A server may be connected to the main control unit 100 via a communication link and allow user to control the operation of the system (e.g. for providing hot water at the time a user reaches home).

Figure 3:
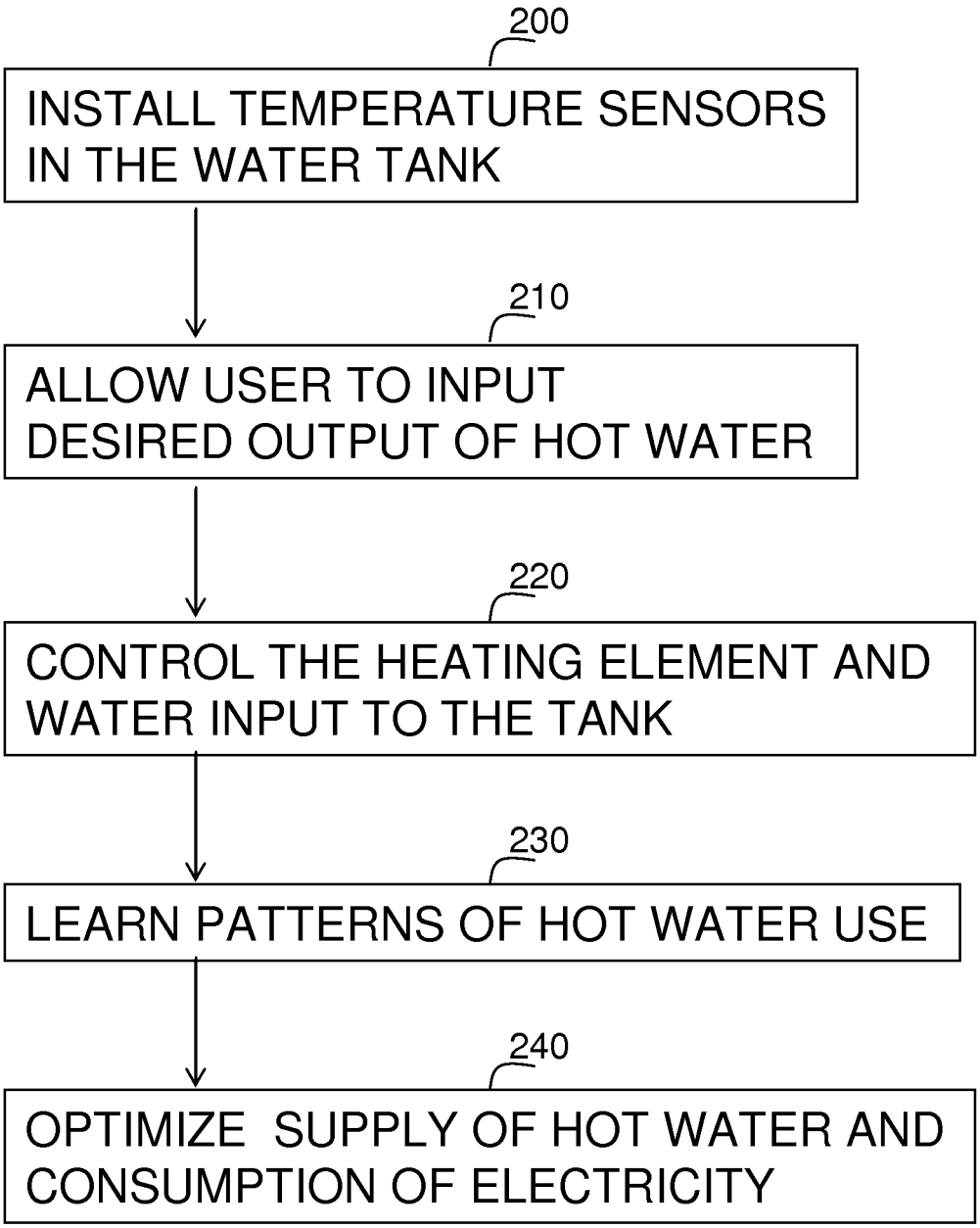
FIG. 3 is a flow chart illustrating a method for reducing the consumption of electricity while supplying heated water from a water tank with an electric heating element, according to some embodiments of the invention.

FIG. 3 is a flow chart illustrating a method for reducing the consumption of electricity while supplying heated water from a water tank with an electric heating element, according to some embodiments of the invention. The method comprises the steps:

- Installing at least one temperature sensor in the water tank (step 200).
- Allowing a user to input desired output of hot water (step 210).
- Controlling the heating element and water input to the tank (step 220).
- Learning patterns of hot water use (step 230).
- Optimizing the supply of hot water and consumption of electricity (step 240).

According to some embodiments of the invention, the user may input user preferences (step 210) by setting the required temperature and pressing an activation button for a single activation. Controlling the heating element (step 220) may comprise activating the heating element until the desired temperature is reached and stopping the heating element. An audio or visual indication may be provided to the user upon stopping.

According to some embodiments of the invention, the user may input user preferences (step 210) by setting the required temperature and pressing an activation button for continuous activation. Controlling the heating element (step 220) may comprise activating the heating element until the desired temperature is reached and stopping the heating element (plus providing an audio or visual indication to the user). Controlling the heating element (step 220) in a continuous activation mode may further comprise preserving the water temperature within a desired range.

According to some embodiments of the invention, controlling the heating element and water input to the tank (step 220) may comprise in water heating systems with a large number of water tanks automatically controlling the faucets to the tanks. In a system with partial solar heating optimizing the supply of hot water and consumption of electricity (step 240) may comprise controlling water circulation flow from the external solar system in relation to the relation between water temperature in the solar heated tanks and water temperature in the electrically heated tanks.

Figure 4:
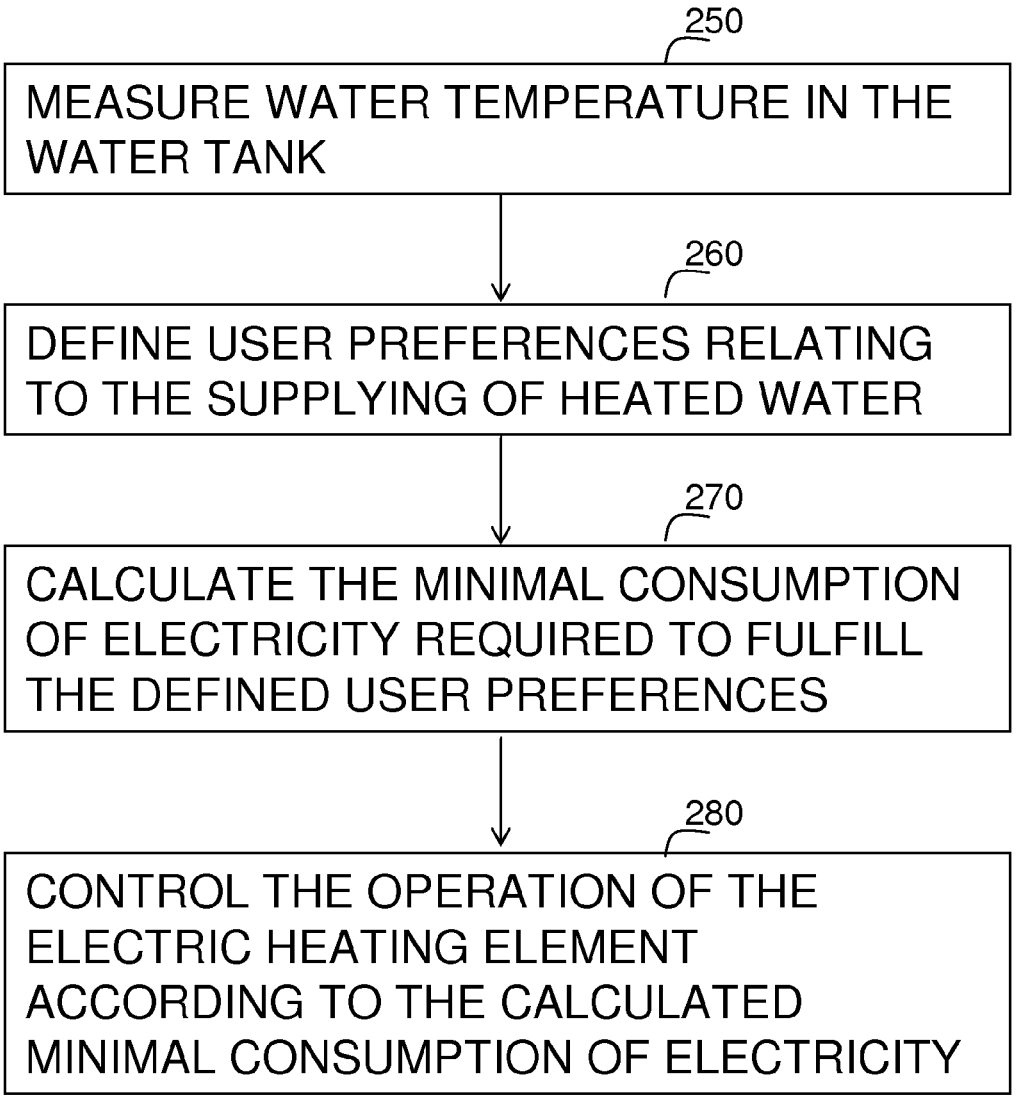
FIG. 4 is a flow chart illustrating a method for reducing the consumption of electricity while supplying heated water from a water tank with an electric heating element, according to some embodiments of the invention.

FIG. 4 is a flow chart illustrating a method for reducing the consumption of electricity while supplying heated water from a water tank with an electric heating element, according to some embodiments of the invention. The method comprises the steps:

- Measuring the water temperature in the water tank (step 250) in predefined intervals and pre defined location in the water tank.
- Defining the user preferences relating to supplying of heated water (step 260).
- Calculating the minimal consumption of electricity required to fulfill the defined user preferences (step 270), utilizing the measured water temperature.
- Controlling the operation of the electric heating element according to the calculated minimal consumption of electricity (step 280).

According to some embodiments of the invention, defining user preferences relating to the supplying of heated water (step 260) may be carried out by defining an expected usage time, a destination temperature, and an expected amount of water.

According to some embodiments of the invention, said calculating the minimal consumption of electricity (step 270) comprises calculating the most effective hysteresis of water temperature in conjunction with water volume and heating element capacity, and adjusting the activation and deactivation of the heating element 185 accordingly. The method may further calculate the time left for reaching a predefined water temperature.

According to some embodiments of the invention, the water in the heating tank is heated via accurate control mechanism to specific pre-defined temperature levels using a friendly, easy to operate, control panel (UI). Once the water reaches the desired temperature level, the heating element is halted. An audio/visual indication is provided to indicate that water ahs reached the desired temperature level and hence, ready for use. In case warm water consumption is postponed, the user can choose the operation mode: Either the control unit will intermittently activate the heating element to preserve the desired water temperature (without over heating) or halt its operation. The invention reduces the amount of energy invested in the water heating process. The user can choose the level of water temperature to be heated and thus save energy invested in un-necessary water heating not being consumed. The heating mechanism will be stopped once water reached required bathing/dish-washing temperature, while in current system the water are usually heated to a much higher temperature. In case the user does not consume hot water immediately; temperatures control system can (if instructed to do so) preserve desired water temperature level without excess heating. Artificial intelligent algorithms learn user habits, predicts when the water will be ready and thus improves time planning. Algorithms may pre-warm water according to time and hot water planning. Algorithms may be applied for predicting the duration for water to reach a desired temperature.

According to some embodiments of the invention, the following items are the main incentive for using the system for controlling the operation of an electric heating element 185 in a water tank 180:

- Massive reduction in electricity consumption by using the system to control the tank heating element which is a major energy consumer within a domestic environment (versus prior art in which usually the heating element is uncontrolled and managed and thus its operation is inefficient e.g. houses, coffee shops, small businesses, etc.).
- Provide safer environment for family members, especially children, employees in small businesses and guests (restaurants, coffee shops, hair salons, barber's shops, etc.).
- The "Are there enough hot water for a decent shower?" question is eliminated, the user interface 101 will indicate the temperature of the water in the tank 180.
- Household member can see via the user interface 101 if water temperature is suited for ones needs, and only if not, consequent action can be made to heat the water in the tank 180.
- Water heating process is much more efficient, hot water can be heated to cover following cases and much more (given temperatures in this paragraphs are averages over the whole volume of the water tank 180):
  - Washing dishes—Moderate heat (20° C.) is applied to heat the water to an intermediate level suitable for washing the dishes, house cleaning, etc.
  - Short shower—about 30° C., minimum heating time of the immediate "high water area of the tank"
  - Baby bath—about 25° C., Accurate water heating to a specified temperature suitable to bath babies.
  - Long shower—about 50° C., The overall water capacity is heated to provide a long relaxing shower.

According to some embodiments, the invention is a new way to graphically display the water temperature in a water tank (boiler) and comprises a unique algorithm to predict heating duration for water to reach desired water temperature as well as a unique algorithm to auto-learn user water heating and shower habits and thus heating water to desired temperature on desired time of the day or week. The invention accomplishes friendly interface, knowledge of the temperature in the tank of solar/electrical water tanks, as well as significant savings in electricity and water due to prevention of excessive electricity use when over heating and when physically checking availability of hot water by running water through the faucet.

According to some embodiments, the invention comprises algorithms for learning user habits and for identifying activation and usage and for assessing the heating time left. The graphical display may present and let set usage types such as baby shower, dish washing, etc. Artificial intelligence may be utilized to learn user bathing habits and operate the heating process accordingly. Operating the heating process comprises planning the time slots during which the water should be warmed and the desired temperature at the end of each slot (e.g. Morning 06:00 AM 60° C., Evening 22:00 PM 40° C.).

Figure 5:
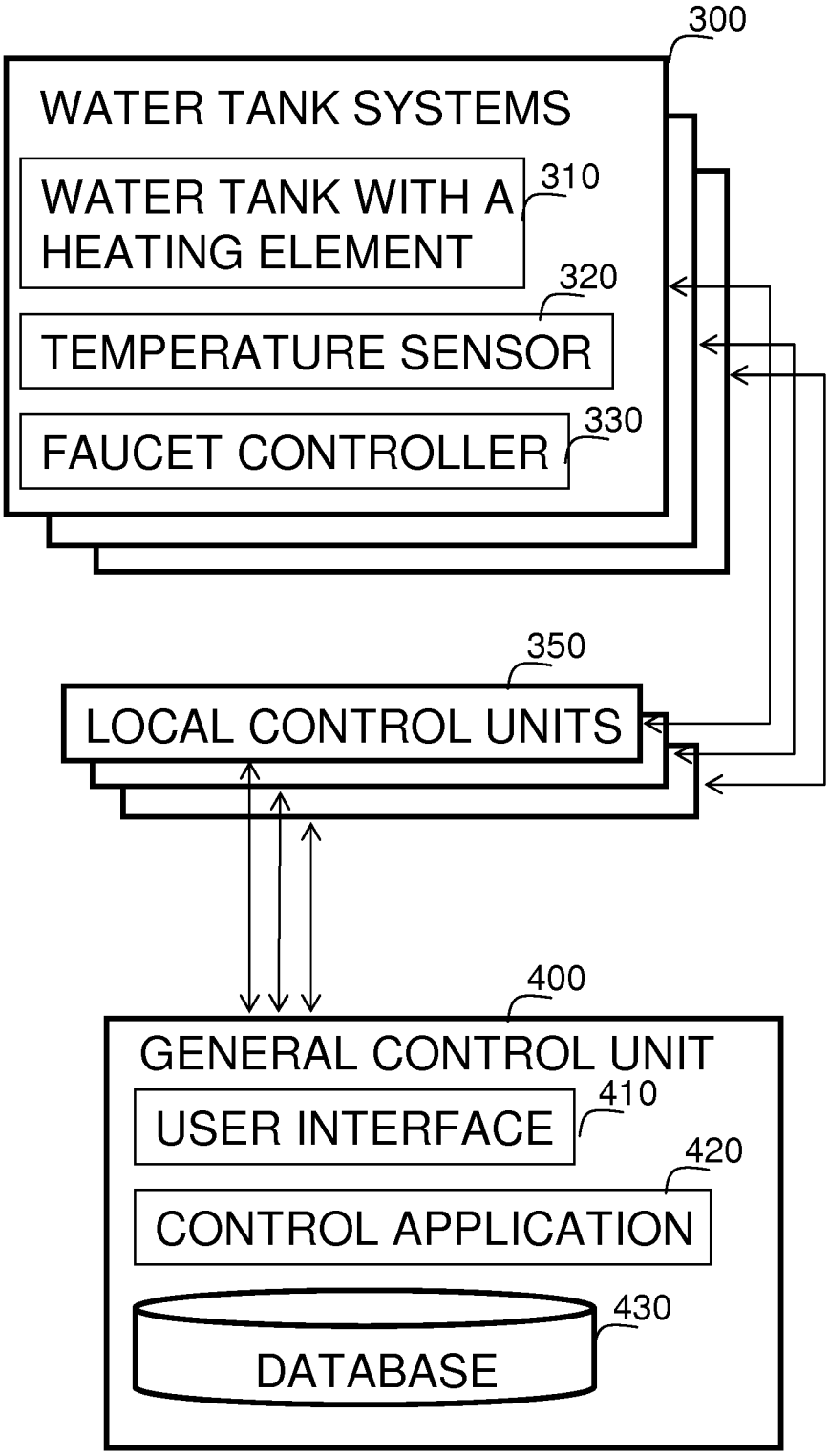
FIG. 5 is a block diagram of a system for controlling several water tank systems, according to some embodiments of the invention.

FIG. 5 is a block diagram of a system for controlling several water tank systems 300, according to some embodiments of the invention. Each water tank system 300 comprises a water tank with a heating element 310, a temperature sensor 320 and a faucet controller 330. Each of the systems is controlled by a local control unit 350 reading the temperature measurements and controlling the heating element and faucets of the respective water tank system. The local control units 350 are controlled by a general control unit 400 comprising a user interface 410, a control application 420 and a database 430. The general control unit 400 is configured to allow users to minimize the energy consumption of a whole group of water tank systems 300, associated e.g. with managed large apartment buildings. The general control unit 400 may utilize interface and control elements similar to those disclosed for the main control unit 100.

In the above description, an embodiment is an example or implementation of the inventions. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is understood that the phraseology and terminology employed herein is not to be construed as limiting and are for descriptive purpose only.

The principles and uses of the teachings of the present invention may be better understood with reference to the accompanying description, figures and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention can be implemented in the testing or practice with methods and materials equivalent or similar to those described herein.

While the invention has been described with respect to a limited number of embodiments, these should not be construed as limitations on the scope of the invention, but rather as exemplifications of some of the preferred embodiments. Those skilled in the art will envision other possible variations, modifications, and applications that are also within the scope of the invention. Accordingly, the scope of the invention should not be limited by what has thus far been described, but by the appended claims and their legal equivalents.

What is claimed is:

1. A water tank comprising:

a heater disposed within a container;

a learning module arranged to learn characteristics of operation of the water tank by measuring the water temperature in the water tank at predefined time intervals and in predefined locations in the water tank, for assessing deteriorating efficiency of the water tank and predicting the duration for water to reach a desired temperature;

a user preference module arranged to receive from a user respective requirements associated with at least one of:
desired hour of hot water use;
desired temperature of the hot water;
desired amount of hot water; and
duration of the hot water use; and a heater control unit arranged to operate the heater in a specified heating pattern over time based at least partially on the user requirements and the characteristics of operation of the water tank, such that electricity consumption of the heater is reduced.

2. The water tank according to claim 1, further comprising one or more temperature sensors disposed in specified locations within the container in operative association with the learning module which is further arranged to deduce at least some of the characteristics of operation of the water tank by measuring temperature in one or more locations over time in view of a specified operating pattern of the heater.

3. The water tank according to claim 1, further comprising a graphical user interface arranged to present the user with an estimated time for meeting the user requirements based on the characteristics of operation of the water tank and current water temperature.

4. The water tank according to claim 1, wherein the specified pattern of operating the heater by the heater control unit exhibit a dynamic duty cycle in which the duty cycle is based on at least one of:
the characteristics of operation of the water tank,
current water temperature, and
user requirements.

5. The water tank according to claim 1, further comprising a user behavior module arranged to learn the user's usage patterns of the water tank, wherein the heater control unit is arranged to further base the specified pattern at least partially on the user's usage patterns.

6. A method comprising:

learning characteristics of operation of a water tank comprising a heater disposed within a container by measuring the water temperature in the water tank at predefined time intervals and in predefined locations in the water tank, for assessing deteriorating efficiency of the water tank and predicting the duration for water to reach a desired temperature;

receiving from a user respective requirements associated with at least one of:
desired hour of hot water use;
desired temperature of the hot water;
desired amount of hot water; and
duration of the hot water use; and operating the heater in a specified heating pattern over time based at least partially on the user requirements and the characteristics of operation of the water tank, such that electricity consumption of the heater is reduced.

7. The method according to claim 6, further comprising deducing at least some of the characteristics of operation of the water tank by measuring temperature in one or more locations over time in view of a specified operating pattern of the heater.

8. The method according to claim 6, further comprising presenting an estimated time for meeting the user requirements based on the characteristics of operation of the water tank and current water temperature.

9. The method according to claim 6, further comprising learning the user's usage patterns of the water tank, wherein the specified pattern is based at least partially on the user's usage patterns.

10. A computer program product comprising a computer readable storage medium having a computer readable program embodied therewith, the computer readable program being configured to (a) learn characteristics of operation of a water tank comprising a heater disposed within a container by measuring the water temperature in the water tank at predefined time intervals and in predefined locations in the water tank, for assessing deteriorating efficiency of the water tank and predicting the duration for water to reach a desired temperature;

(b) receive from a user respective requirements associated with at least one of:
desired hour of hot water use;
desired temperature of the hot water;
desired amount of hot water; and
duration of the hot water use; and (c) operate the heater in a specified heating pattern over time based at least partially on the user requirements and the characteristics of operation of the water tank, such that electricity consumption of the heater is reduced.

11. A system for controlling the operation of an electric heating element in a water tank, said system comprising:

at least one temperature sensor in said water tank;

a main control unit arranged to receive water temperature measurements from said at least one temperature sensor and to control the operation of said electric heating element, said main control unit comprising:

a learning module arranged to learn characteristics of operation of the water tank by analyzing temperature measurements from the at least one temperature sensor in specific intervals over a specified period of time in view of an operating time of the heating element;

and learn water tank usage patterns by tracing previous usage patterns, over a specified period of time;

a user interface configured to allow a user to input preferences relating to hot water supply and configured to display information relating to the temperature of the water in said water tank;

a control application configured to activate said electric heating element according to user preferences and said water temperature measurements, wherein said control application is configured to operate the heating elements such that it minimizes the energy consumption of said water tank based on the characteristics of operation of the water tank and the usage pattern of the water tank.

12. The system of claim 11, further comprising temperature control circuitry associated with said temperature sensor and with said main control unit, said temperature control circuitry arranged to transmit temperature measurements from the temperature sensor to the main control unit over a communication link.

13. The system of claim 11, wherein said main control unit is coupled to said temperature sensor via a communication link and wherein said communication link utilizes power line communication.

14. The system of claim 11, wherein said control application is coupled to said electric heating element via a communication link and wherein said communication link utilizes power line communication.

15. The system of claim 11, wherein said user uses said user interface via at least one of the following: A USB interface, a wire line (LAN) network, a wireless (WLAN) network, a cellular interface, Bluetooth technology, Ethernet.

16. The system of claim 11, wherein said user uses said user interface via SMS commands.

17. The system of claim 11, wherein said main control unit is further configured to monitor changing characteristics of operation of said water tank.

18. The system of claim 11, wherein said main control unit further comprises a water supply module arranged to control at least one of the following indicators:

amounts of incoming and outgoing water into and from said water tank, water stand in said water tank, operation of faucets associated with said water tank, a combination thereof.

19. An apparatus for controlling the operation of an electric heating element in a water tank, said apparatus comprising:

a learning module arranged to:

take temperature measurements at specific time intervals over a specified period of time from at least one temperature sensor in said water tank; and learn characteristics of operation of said water tank by analyzing said temperature measurements;

a user interface configured to allow a user to input preferences relating to hot water supply; and a control application configured to activate said electric heating element according to user preferences, said water temperature measurements, and said characteristics of operation of said water tank;

wherein said control application is configured to operate the heating element such that it minimizes the energy consumption of said water tank.

* * * * *